US009028171B1

(12) United States Patent
Seldner

(10) Patent No.: US 9,028,171 B1
(45) Date of Patent: May 12, 2015

(54) GEOTHERMAL PYROLYSIS PROCESS AND SYSTEM

(71) Applicant: Josh Seldner, Santa Monica, CA (US)

(72) Inventor: Josh Seldner, Santa Monica, CA (US)

( * ) Notice: Subject to any disclaimer, the term of this patent is extended or adjusted under 35 U.S.C. 154(b) by 0 days.

(21) Appl. No.: 13/940,163

(22) Filed: Jul. 11, 2013

Related U.S. Application Data

(60) Provisional application No. 61/703,056, filed on Sep. 19, 2012, provisional application No. 61/720,699, filed on Oct. 31, 2012.

(51) Int. Cl.
*C10G 1/00* (2006.01)
*B09B 3/00* (2006.01)

(52) U.S. Cl.
CPC ..... *B09B 3/0083* (2013.01)

(58) Field of Classification Search
CPC ..... C10G 1/02; C10G 1/04; B09B 3/0083; F23G 2900/50202
USPC ..... 405/129.2, 129.28; 585/240; 201/15
See application file for complete search history.

(56) References Cited

U.S. PATENT DOCUMENTS 4,030,549 A 6/1977 Bouck
4,473,120 A * 9/1984 Jennings ..... 208/426
5,484,231 A * 1/1996 Cannan et al. ..... 405/129.4
6,862,886 B2 * 3/2005 Stewart ..... 60/641.2
7,063,145 B2 * 6/2006 Veenstra et al. ..... 166/250.01
7,575,052 B2 * 8/2009 Sandberg et al. ..... 166/248
7,878,131 B2 * 2/2011 Becchetti et al. ..... 110/230
7,947,155 B1 * 5/2011 Green et al. ..... 201/2
2006/0102625 A1 * 5/2006 Kinzer ..... 219/772
2006/0280669 A1 * 12/2006 Jones ..... 423/445 R
2008/0264771 A1 * 10/2008 Dam-Johansen et al. ..... 201/4
2009/0007484 A1 * 1/2009 Smith ..... 44/606
2010/0101142 A1 * 4/2010 Eisner et al. ..... 44/607
2011/0094952 A1 * 4/2011 Dana et al. ..... 210/185
2011/0308801 A1 * 12/2011 Dana ..... 166/302

* cited by examiner

*Primary Examiner* — Benjamin Fiorello
(74) *Attorney, Agent, or Firm* — Plager Schack LLP

(57) ABSTRACT

A geothermal pyrolysis system is configured to convert a slurry into a petroleum material. The geothermal pyrolysis system comprises an input well configured to receive the slurry from a mixer. Piping that is mechanically coupled to the input well and extending downward to a point where the earth has an ambient temperature exceeds three hundred degrees Fahrenheit and can transform the slurry into the petroleum material. An extraction well is mechanically coupled to the piping configured to extract the petroleum material from the piping. A separator is mechanically coupled to the extraction well which separates the petroleum material into carbon char, water, oil and gas.

6 Claims, 4 Drawing Sheets

GEOTHERMAL PYROLYSIS PROCESS AND SYSTEM

RELATED APPLICATION

This application claims priority to provisional patent application U.S. Ser. No. 61/703,056 filed on Sep. 19, 2012 and provisional patent application U.S. Ser. No. 61/720,699 filed on Oct. 31, 2012, the entire contents of both applications are herein incorporated by reference.

BACKGROUND

The embodiments herein relate generally to systems that produce a thermochemical decomposition of organic material at elevated temperatures in the absence of oxygen or any halogen.

Prior to the disclosed invention, pyrolysis involved some inefficient artificial heating source that required substantial energy to accomplish and was therefore inefficient. The prior art includes U.S. Pat. No. 8,318,997 issued to McAlister; U.S. Patent Application Publication 2013/0068457 filed by Thach; and U.S. Patent Application Publication 2012/0312545 filed by Suryanarayana.

McAlister teaches a machine to produce petroleum from organic waste. The machine comprising, a mixer which can convert organic waste into a biomass slurry, a pump mechanically coupled to the mixer and a pipe which can push the biomass slurry through a geothermal heat exchanger converting the biomass slurry to petroleum and then to a flash tank system which can separate and store the petroleum. McAlister does not teach a second pump because it is not trying to move the biomass slurry through the strata layer of the earth, as a result a single pump provides sufficient head to accomplish this.

Thach teaches a method of making surfactants which is chemically similar to the existing process, but Thach relies on low-molecular weight alcohol to react with a bio-lipid instead of heat. This is a different way of accomplishing the known process of breaking down biomass into petroleum.

Suryanarayana teaches a power generation system comprising, a pump mechanically coupled to a compressor that can move a dynamic fluid through a geothermal heat exchanger adding energy to the dynamic fluid which can be used to turn a turbine and create electrical power. There is no theory on what the dynamic fluid is but typically steam or air would be used. It is unlikely that a biomass slurry would accomplish this since the heat of formation is too high for those compositions of matter.

SUMMARY

A geothermal pyrolysis system is configured to convert a slurry into a petroleum material. The geothermal pyrolysis system comprises an input well configured to receive the slurry from a mixer. Piping that is mechanically coupled to the input well and extending downward to a point where the earth has an ambient temperature exceeds three hundred degrees Fahrenheit and can transform the slurry into the petroleum material. An extraction well is mechanically coupled to the piping configured to extract the petroleum material from the piping. A separator is mechanically coupled to the extraction well which separates the petroleum material into carbon char, water, oil and gas.

In some embodiments, the mixer is mechanically coupled to the input well with a high pressure pump. The extraction well is mechanically coupled to the separator with a transfer pump. A portion of the piping is surrounded with a lining.

A geothermal pyrolysis process permits efficient transformation from feedstock to oil. The geothermal pyrolysis process comprises the following steps, not necessarily in order, A user separates feedstock by chemical process needed to transform the feedstock into oil. A mixer grinds the feedstock and inserting a catalyst to create a slurry. An input well pumps the slurry into the earth where an ambient temperature exceeds three hundred degrees Fahrenheit. The earth cooks the slurry into a petroleum material via pyrolysis. An extraction well pumps the petroleum material from the earth. A separator separates oil from the petroleum material.

In some embodiments hydrous pyrolysis is used. The mixer inserts water into the slurry.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
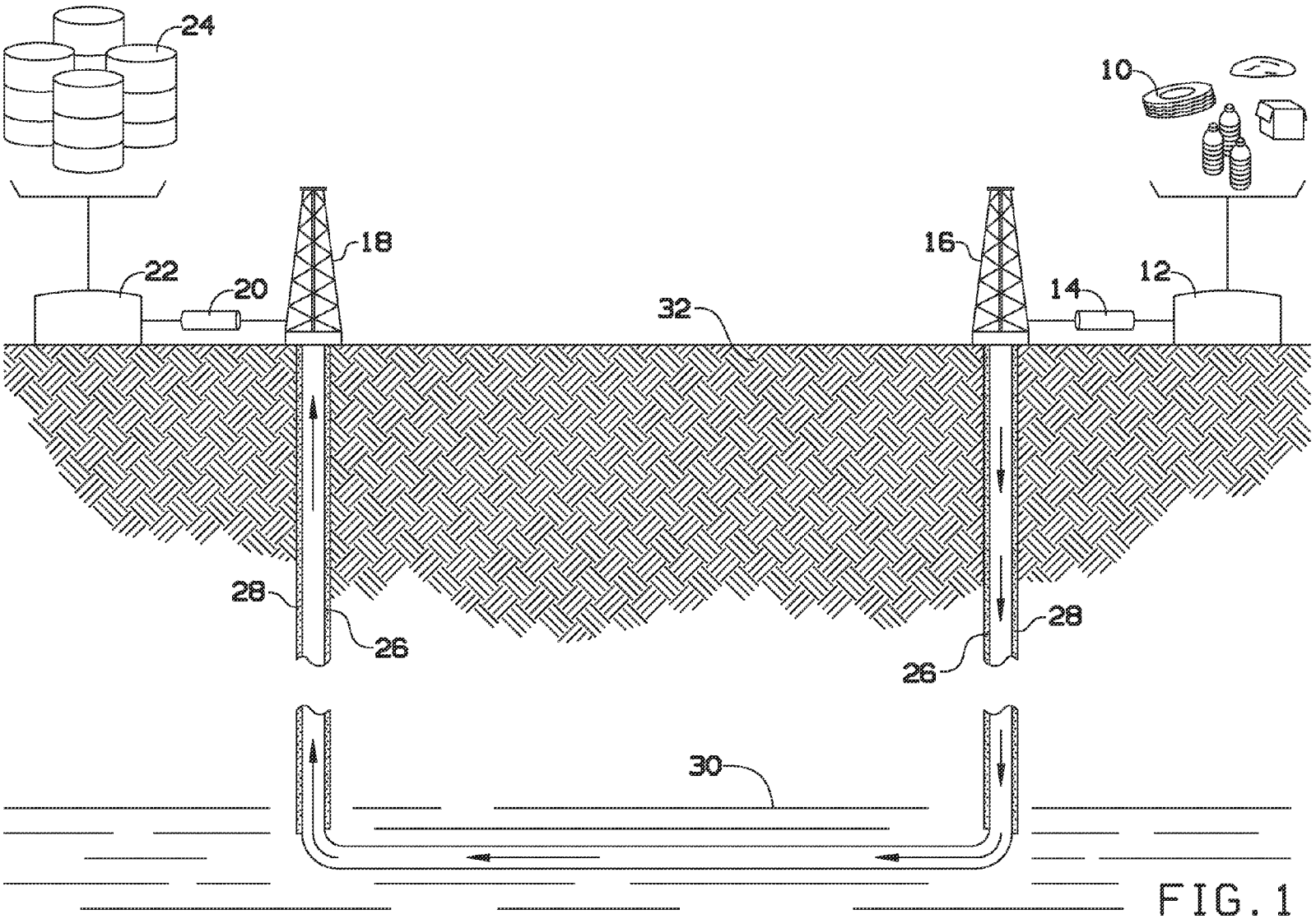
FIG. 1 is a schematic view of an embodiment of the invention.

By way of example, and referring to FIG. 1, one embodiment of a geothermal pyrolysis system comprises feedstock 10 being inserted into mixer 12. Feedstock 10 can be any organic material, which is material that contains carbon. Mixer 12 cuts up and blends feedstock 10 with other materials as explained in more detail in FIG. 2 creating a biomass slurry that is pumped into input well 16 with high pressure pump 14.

Input well 16 typically rests on earth's crust 32 and is mechanically coupled to a portion of the pipeline 26 is surrounded with lining 28. In some embodiments, lining 28 is a cement rock lining that insulates pipeline 26 and prevents condensation of feedstock 10 into earth's crust 32. In some embodiments, pipeline 26 can be a steel alloy pipeline. In a substantial deviation from McAlister and Suryanarayana, pipeline 26 travels below earth's crust 32 and into strata 30. The ambient temperature in strata 30 is greater than three hundred degrees Fahrenheit. It is well known that the temperature of the strata layer varies widely depending on a depth below the surface of the earth and the precise location of input well 16. Nonetheless, in many embodiments, depths of 1000 feet to 500 miles are adequate.

Pipeline 26 returns upward through earth's crust 32 and is again surrounded by lining 28 as it approaches the surface. Pipeline 26 is mechanically coupled to extraction well 18. Extraction well 18 pulls feedstock 10 from pipeline 18 and then transfers feedstock 10 into separator 22 with transfer pump 20. Separator 22 separates any remaining debris from petroleum material 24 which can be used as fuel.

Figure 2:
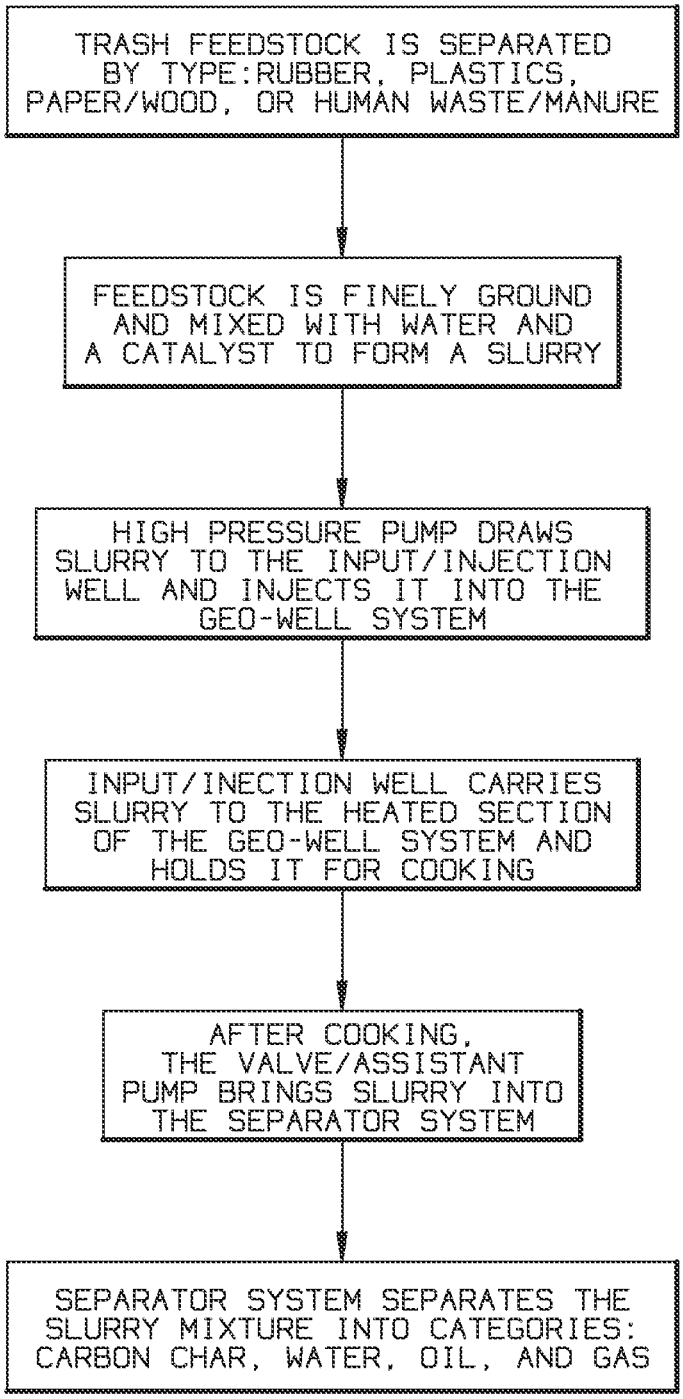
FIG. 2 is a flowchart of an embodiment of the invention.

FIG. 2 explains a geothermal pyrolysis process which accomplishes this in more detail. In some embodiments, feedstock 10 is initially separated by type because different kinds of feedstock involve slightly different pyrolysis processes. Rubber, plastics, paper, wood, human waste and manure are all separated. In other embodiments, different kinds of feedstock are combined. In either case, the feedstock is finely ground and mixed with water (in some embodiments) and a catalyst to form a slurry.

There are many combinations of catalysts that can be effective. For instance, anhydrous pyrolysis is simply heating organic material without water and is more/less the process that would naturally occur within the earth. Hydrous pyrolysis can also be used to produce liquid fuel similar to diesel from turkey offal, wood chips or many other organic materials by mixing the feedstock with water. In U.S. Pat. No. 2,177,557 issued to Bergstrom, combining water, wood chips and calcium hydroxide is discussed. In Zhang, Thermochemical Conversion of Swine Manure to Produce Fuel and Reduce Waste (1999) available at: http://age-web (dot) age (dot) uiuc (dot) edu (slash) bee (slash) RESEARCH (slash) tcc (slash) tccpaper3 (dot) htm, swine manure was combined with water using sodium carbonate and hydroxyl groups. Other compounds also exist and are known to the prior art.

At this point, a user can flush piping 26 with water to prime input well 16 and extraction well 18. This also removes ambient air from the pipes that would otherwise frustrate suction in extraction well 18 and would prevent pyrolysis from occurring (because of the presence of oxygen).

Once primed, high pressure pump 14 draws the slurry into input well 16 and through piping 26. This enables the slurry to cook in the strata turning the slurry into a variety of petroleum discussed above. Then extraction well 18 pulls the petroleum from the piping. Extraction well 18 can be designed similar to an oil derrick. In the event material in piping 26 becomes stuck steam can be injected into piping 26 to dislodge the material. Transfer pump 20 pumps the petroleum into separator 22 where it is separated into carbon char, water, oil and gas.

Figure 3:
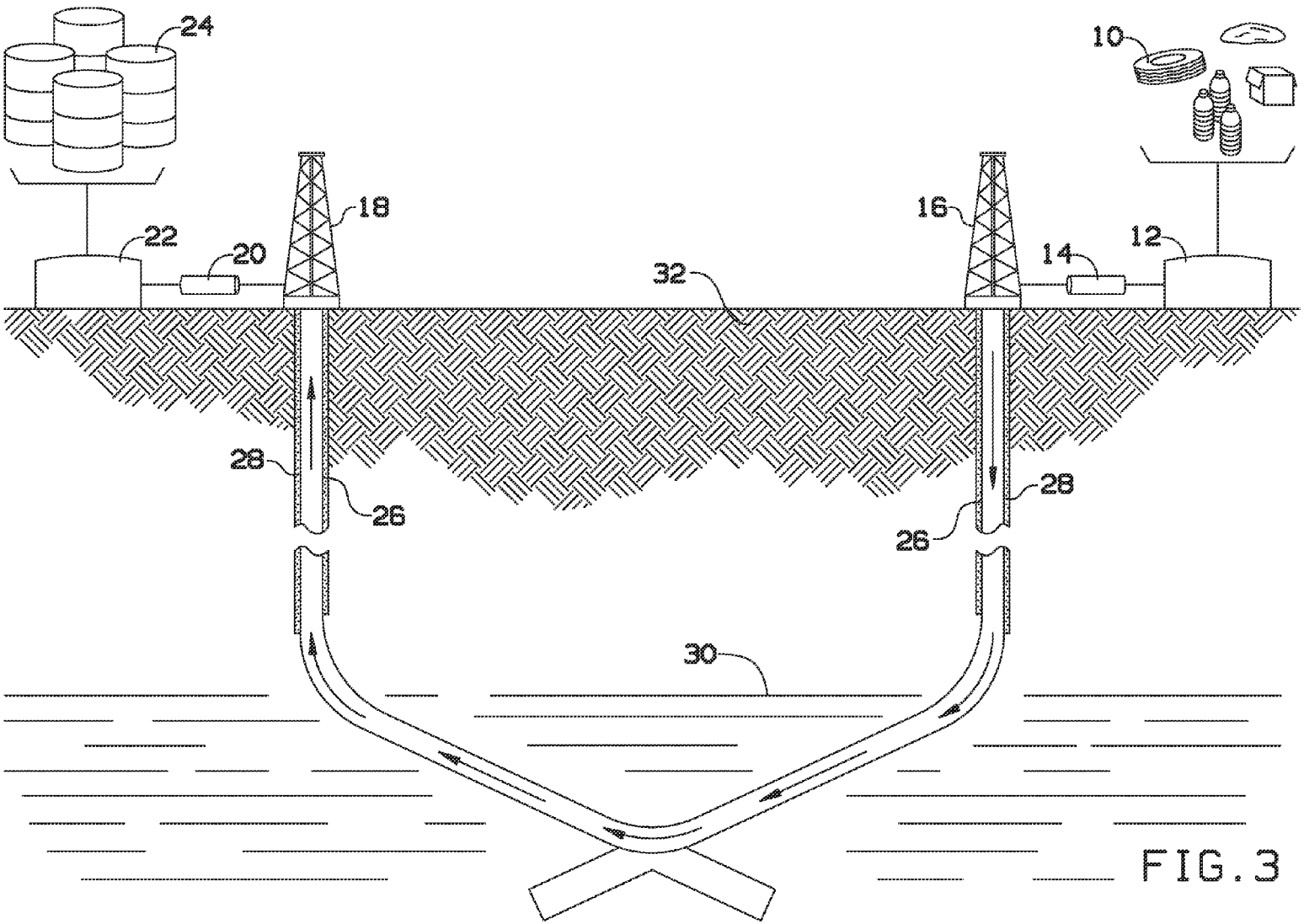
FIG. 3 is a schematic view of an alternate embodiment of the invention.
Figure 4:
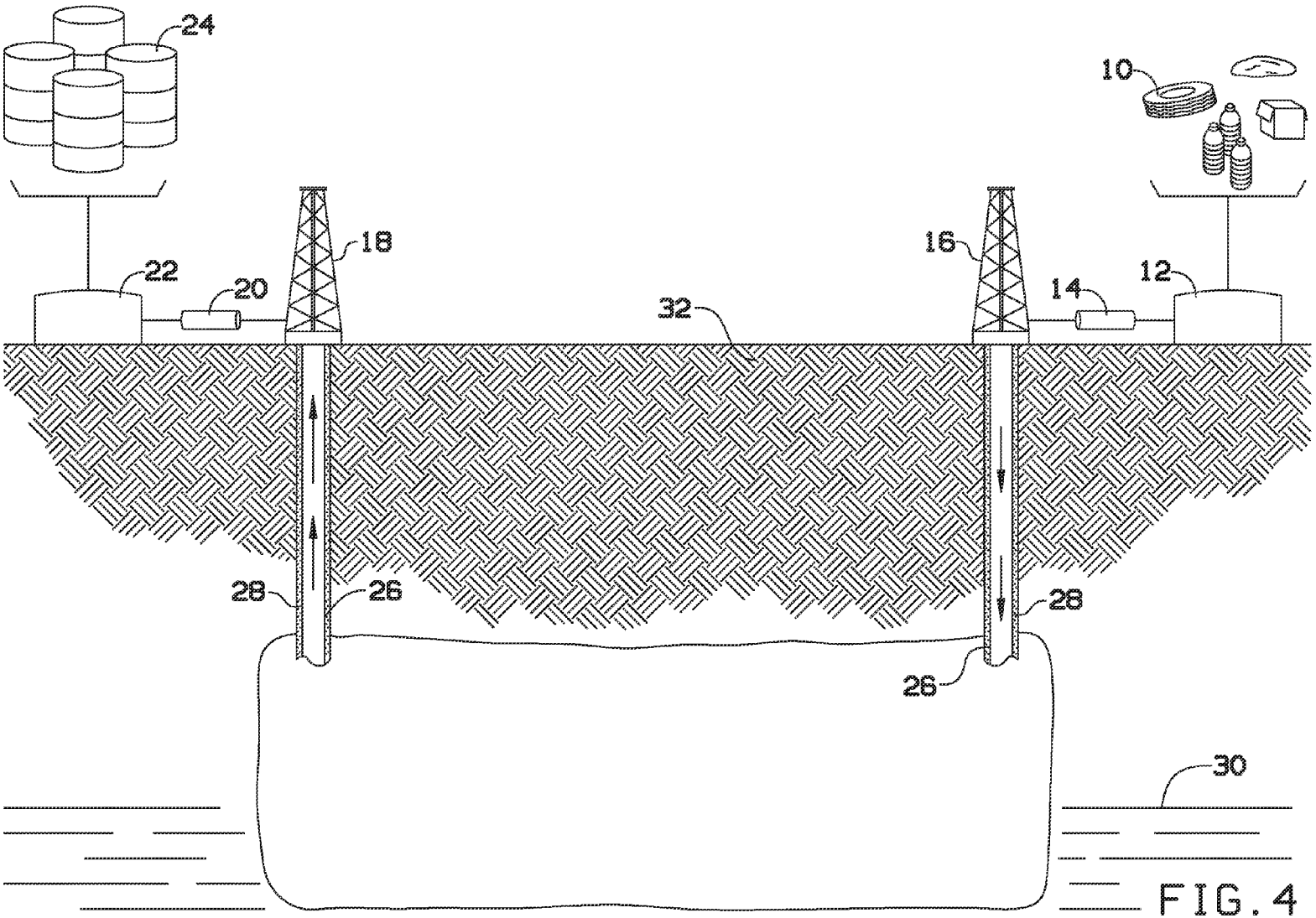
FIG. 4 is a schematic view of an alternate embodiment of the invention.

Depending on the geological nature of earth's crust 32 and strata 30 different arrangements of pipeline 26 and lining 28 may be more appropriate. For instance in FIG. 1, a U-shaped configuration is shown that may be appropriate in some instances. FIG. 3 shows a configuration made with cross-drilling. FIG. 4 shows a configuration that utilizes a pre-existing well that has been drained.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A geothermal pyrolysis system configured to convert a slurry into a petroleum material, the geothermal pyrolysis system comprising:

a mixer, configured to cut a feedstock and mix the feedstock with a catalyst; wherein the feedstock is at least one of the group consisting of: rubber, plastics, paper, wood, human waste and manure; wherein the catalyst is one of: calcium hydroxide, sodium carbonate, or water;

an input well configured to receive the slurry from a mixer; wherein the input well is a first oil derrick;

piping, mechanically coupled to the input well, that seals the slurry to prevent any gas from escaping, having a first vertical portion extending downward to a point where the earth has an ambient temperature exceeds three hundred degrees Fahrenheit having a horizontal portion that heats the slurry in an endothermic process in order to transform the slurry into the petroleum material without damaging the piping; and a second vertical portion extending upward;

an extraction well mechanically coupled to the second horizontal portion of the piping; wherein the extraction well is a second oil derrick configured to extract the petroleum material from the piping below atmospheric pressure;

a separator mechanically coupled to the extraction well which separates the petroleum material into carbon char, water, oil and gas.

2. The geothermal pyrolysis system of claim 1, wherein the mixer is mechanically coupled to the input well with a high pressure pump.

3. The geothermal pyrolysis system of claim 1, wherein the extraction well is mechanically coupled to the separator with a transfer pump.

4. The geothermal pyrolysis system of claim 1, wherein a portion of the piping is surrounded with a lining.

5. A geothermal pyrolysis process permits efficient transformation from feedstock to oil, the geothermal pyrolysis process comprising:

separating feedstock by a chemical process needed to transform the feedstock into oil;

grinding the feedstock and inserting a catalyst to create a slurry; wherein the catalyst is one of: calcium hydroxide, sodium carbonate, or water;

pumping the slurry into the earth with a first oil derrick until the ambient temperature exceeds three hundred degrees Fahrenheit;

sealing the slurry in pipes in order to prevent any gas from escaping;

cooking the slurry into a petroleum material via pyrolysis;

pumping the petroleum material from the earth with a second oil derrick; and separating oil from the petroleum material.

6. The geothermal pyrolysis process of claim 5, further comprising inserting water into the slurry for use in hydrous pyrolysis.

* * * * *